US006878680B2

(12) United States Patent
Kitko et al.

(10) Patent No.: US 6,878,680 B2
(45) Date of Patent: Apr. 12, 2005

(54) DETERGENT COMPOSITIONS AND COMPONENTS THEREOF

(75) Inventors: David Johnathan Kitko, Cincinnati, OH (US); Colin Stephenson, Newcastle Upon Tyne (GB)

(73) Assignee: Procter & Gamble, Cincinnati, OH (US)

( * ) Notice: Subject to any disclaimer, the term of this patent is extended or adjusted under 35 U.S.C. 154(b) by 41 days.

(21) Appl. No.: 10/426,540

(22) Filed: Apr. 30, 2003

(65) Prior Publication Data

US 2003/0232734 A1 Dec. 18, 2003

Related U.S. Application Data

(60) Provisional application No. 60/377,304, filed on May 2, 2002.

(51) Int. Cl.[7] ..... C11D 7/08; C11D 7/54; C11D 17/00

(52) U.S. Cl. ..... 510/311; 510/367; 510/376; 510/444; 510/445; 510/477; 510/488

(58) Field of Search ..... 510/311, 367, 510/376, 444, 445, 477, 488; 8/137

(56) References Cited

U.S. PATENT DOCUMENTS

| | | | | |
|---|---|---|---|---|
| 4,397,757 A | | 8/1983 | Bright et al. | |
| 4,751,015 A | | 6/1988 | Humphreys et al. | |
| 4,904,406 A | | 2/1990 | Darwent et al. | |
| 4,988,451 A | | 1/1991 | Nunn et al. | |
| 5,093,022 A | | 3/1992 | Sotoya et al. | |
| 5,106,528 A | | 4/1992 | Francis et al. | |
| 5,127,852 A | | 7/1992 | Cravens et al. | |
| 5,269,962 A | | 12/1993 | Brodbeck et al. | |
| 5,360,568 A | | 11/1994 | Madison et al. | |
| 5,360,569 A | | 11/1994 | Madison et al. | |
| 5,370,826 A | | 12/1994 | Madison et al. | |
| 5,480,577 A | * | 1/1996 | Nicholson et al. | 510/372 |
| 5,747,441 A | * | 5/1998 | Domburg et al. | 510/375 |
| 5,795,854 A | * | 8/1998 | Angell et al. | 510/312 |
| 6,174,853 B1 | | 1/2001 | Bockh et al. | |
| 6,225,274 B1 | | 5/2001 | Nitsch et al. | |
| 6,399,557 B2 | * | 6/2002 | Perkins et al. | 510/310 |

FOREIGN PATENT DOCUMENTS

| | | |
|---|---|---|
| EP | 0 072 166 A1 | 2/1983 |
| EP | 0 124 341 A2 | 11/1984 |
| EP | 0 141 472 A2 | 5/1985 |
| EP | 0 170 346 A1 | 2/1986 |
| EP | 0 170386 A2 | 2/1986 |
| EP | 0 224 952 A2 | 6/1987 |
| EP | 0 224 953 A2 | 6/1987 |
| EP | 0 225 663 A2 | 6/1987 |
| EP | 0 273 775 A2 | 7/1988 |
| EP | 0 201 113 B1 | 9/1988 |
| EP | 0 201 943 B1 | 3/1989 |
| EP | 0 332 294 A2 | 9/1989 |
| EP | 0 141 470 B1 | 4/1991 |
| EP | 0 458 396 A1 | 11/1991 |
| EP | 0 475 512 A1 | 3/1992 |
| EP | 0 544 440 A2 | 6/1993 |
| EP | 0 284 292 B1 | 10/1994 |
| EP | 0 659 876 A2 | 6/1995 |
| EP | 0 482 807 B1 | 12/1995 |
| GB | 836988 | 6/1960 |
| GB | 864798 | 4/1961 |
| GB | 1147871 | 4/1969 |
| GB | 1 382 594 | 2/1975 |
| GB | 2 143 231 A | 2/1985 |
| JP | 1-158097 | 6/1989 |
| WO | WO 94/21777 A1 | 9/1994 |
| WO | WO 94/24251 A1 | 10/1994 |
| WO | WO 95/03393 A1 | 2/1995 |
| WO | WO 95/06211 A1 | 3/1995 |
| WO | WO 95/06710 A1 | 3/1995 |
| WO | WO 95/06711 | 3/1995 |
| WO | WO 95/27036 A1 | 10/1995 |
| WO | WO 95/30733 A1 | 11/1995 |
| WO | WO 95/33817 A1 | 12/1995 |
| WO | WO 97/14780 A1 | 4/1997 |
| WO | WO 97/16521 A1 | 5/1997 |
| WO | WO 98/01531 A2 | 1/1998 |
| WO | WO 98/03625 A1 | 1/1998 |
| WO | WO 98/03626 A2 | 1/1998 |
| WO | WO 98/39098 A1 | 9/1998 |
| WO | WO 99/14245 A1 | 3/1999 |
| WO | WO 01/64826 A2 | 9/2001 |

* cited by examiner

*Primary Examiner*—Gregory R. Del Cotto
(74) *Attorney, Agent, or Firm*—James F McBride; Kim W Zerby; Steven W Miller

(57) ABSTRACT

Detergent compositions comprising bleach catalysts or perfumes are disclosed. In particular, components comprising the bleach catalysts or perfumes are disclosed. In particular, the bleach catalysts are formed into stable particles having low moisture content and low moisture pick-up. Particles are also described having low surface area. Particles containing bleach catalysts or perfumes are also described comprising a protective agent which reacts with water to form non-water reaction products, particularly preferred protective agents being bleach activators.

19 Claims, No Drawings

DETERGENT COMPOSITIONS AND COMPONENTS THEREOF

CROSS REFERENCE TO RELATED APPLICATIONS

This application claims priority under 35 U.S.C. § 119(e) to U.S. Provisional Application Ser. No. 60/377,304, filed May 2, 2002.

TECHNICAL FIELD

The present invention relates to detergent compositions and to the incorporation of components comprising moisture-sensitive ingredients into such compositions. In particular the invention relates to detergent components comprising bleach catalysts and their incorporation into detergents.

BACKGROUND TO THE INVENTION

The incorporation of some ingredients into detergent compositions is problematic. Detergent compositions are often stored for some time and interactions may occur between active components such that a reduction in the amount of the active component may result. This can be particularly problematic in the presence of moisture.

In addition, when those ingredients are high value, highly active ingredients that are incorporated at very low levels, an additional problem arises as it is difficult to effect homogeneous distribution of such active components throughout the detergent. As a result, it is difficult to obtain even delivery of active ingredients from a packet of detergent product. Examples of such ingredients are bleach catalysts and perfumes; the problem is particularly acute with detergent actives such as bleach catalysts because their inactivation adversely affects the cleaning performance of the detergent products.

Many ways of protecting and delivering sensitive, highly active, low dosage detergent components have been suggested. In EP-A-0072166, EP-A-0124341, EP-A-224952 and WO 95/06710, heavy metal complexes are incorporated into detergent compositions in agglomerated or aggregate form in order to improve storage stability. In EP-A-170346, bleach catalysts are adsorbed onto solid silicon supports. In EP-A-141 470, heavy metal ion catalysts are protected by selecting specific ligands and then providing a protective coating; in EP-A-141472, micronised coatings are described. In EP-A-544 440, gelled polymers are used; in WO 95/33817, wax encapsulation is used requiring a surfactant in the particle.

Unfortunately, coating methods are costly and coated/encapsulated particles are vulnerable to fissures or incomplete coatings leading to loss of the active component(s) in the particle. As a result, there is still a need for a stable particle comprising bleach catalyst.

The present inventors have found that a stable uncoated particle containing sensitive ingredients can be obtained by selection and treatment of the other ingredients in the detergent particle.

In accordance with the present invention there is now provided a particle, optionally coated, comprising a perfume, bleach catalyst or ligand thereof and a protective agent, the particle having a moisture content measured according to the Karl Fischer test defined herein (measured on the uncoated particle) of less than 0.5 wt %, preferably no greater than 0.25 wt % and a moisture pick-up measured according to the test defined herein (measured on the uncoated particle) of no greater than 0.5 wt %, preferably no greater than 0.2 wt %.

In a further aspect of the invention an optionally coated particle is provided, comprising a perfume, bleach catalyst or ligand thereof, and a protective agent, uncoated particle having a surface area of no greater than 0.6 $m^2/g$ particle, preferably no greater than 0.4 $m^2/g$, and a medium particle size from 200 to 1500 $\mu$m, preferably from 200 to 1000 $\mu$m.

In a further aspect of the invention there is provided a particle comprising a perfume, bleach catalyst or ligand thereof and a protective agent that reacts with water to form non-water reaction products.

In a further embodiment of the invention, there is provided a particle comprising a perfume, bleach catalyst or ligand thereof and a bleach activator.

The present invention particularly relates to particles comprising bleach catalyst or ligand thereof, particularly comprising bleach catalyst.

Karl Fischer Method for Determining Moisture Content

The moisture content limitation found in Applicants' specification and claims is measured according to Karl Fischer moisture measurement method as follows: a Denver Instrument Company Model 100 Titration Controller is used according to operating instructions named P/N 300464-1 REV B.

A sample of approximately 1 gram product, the moisture content of which is to be determined, is weighed to 4 decimal places on a standard analytical balance and placed in a reagent vessel of the Denver Instrument Titration Controller. 100–150 ml reagent (Hydramal AG, a proprietary mixture comprising methanol, imidazole, sulphur dioxide and diethanolamine, purchased from Fischer Scientific) is placed in the reagent vessel. The cap is placed on the reagent vessel and the weight of the sample is programmed into the computer. A coulometric titration is then carried out; as titration takes place, one electrode generates iodine from the reagent and the iodine reacts with moisture (water) from the sample:

$$CH_3OH+SO_2+RN\rightarrow[RNH][SO_3CH_3]I_2+H_2O+[RNH][SO_3CH_3]=2RN\rightarrow[RNH][SO_4CH_3]+2[RNH][I](RN=base)$$

A second measurement electrode detects when a trace of excess iodine is present (the end-point) and uses digital control to pulse the generator electrode and produce reactive iodine. As long as water is present, the iodine generated is consumed in the Karl Fischer reaction. When no more water is present, the iodine remains and the titration end-point is reached. The instrument provides a reading of wt % water in the sample, taking into consideration the weight of the sample tested.

Moisture Pick-Up

The moisture pick-up limitation found in Applicants' specification and claims is measured according to the following protocol. Using a DVS-1 Automated Water Sorption Analyser from Surface Measurement Systems Limited in accordance with the Operations Manual: a sample of product for moisture pick-up measurement is placed in the sample chamber of the Sorption Analyser without overfilling the sample chamber (this will be from 3 to 25 mg depending on the density of the sample, and is usually around 12 mg). The sample chamber is located in the glass chamber of the Sorption Analyser and the humidity, temperature and airflow can be controlled and weight gain/loss measured without removal from the chamber.

Once the sample is in place, and the glass chamber is closed, starting at 0% humidity, 25° C. air is passed through the glass chamber at a rate of 200 $cm^3$/minute to equilibration weight gain. Equilibration is considered to be the point where dm/dt<0.002 i.e. the weight gain of the sample must be measured as less than 0.0005% per minute for 10 consecutive minutes. Once the sample has reached this state of equilibrium, the humidity of the air is increased in 10% increments. The humidity cycle for the testing is from 0 to 80% relative humidity and then back down at 10% intervals from 80% to 0%. The maximum weight (b) of the sample is recorded and the % weight gain is calculated based on the minimum weight of the sample (a): % weight gain=(b−a)/a×100.

Surface Area Measurement Method

The surface area limitation found in Applicants' specification and claims is measured according to the following protocol. Using a micrometrics Gemini 2360 Surface Area analyser in accordance with the operator's manual v1.00 (part number 236-42801-01, June 1991), the surface area of a test sample of particles is measured. A pre-weighed sample of 1 g+/−0.2 g is placed in a glass vial in the heated jacket. This is pre-heated for 4 hours at 55° C. and simultaneously purged with nitrogen gas. The sample vial is then placed in the test chamber and a mixture of nitrogen and helium gas is passed through the test chamber. Gas is adsorbed onto the test sample until equilibrium adsorption is reached (determined by the machine). The machine analyses the amount of gas adsorbed and provides a reading for surface area in $m^2$/g test sample.

Bleach Catalyst

The particle generally contains a bleach catalyst or ligand thereof. Unlike so-called bleach activators or bleach precursors which function by a perhydrolysis reaction with a peroxygen compound e.g. hydrogen peroxide or a hydrogen peroxide source such as a percarbonate or perborate salt, forming a peroxyacid in situ, the bleach catalysts referred to herein are true catalysts which catalytically enhance the performance of peroxygen bleaching agents. In order to produce a significant effect, bleach activators or precursors are usually used at levels in the order of percent by weight in detergent or cleaning compositions, whereas effective amounts of catalyst are much lower: levels can be as low as hundredths of a percent.

Preferred bleach catalysts for incorporation into the particles of the present invention comprise both transition metal ions (i.e. a 'd' block metal ion, preferably selected from manganese in oxidation states II-IV, iron in oxidation states II-V, copper I-III, cobalt I-III, titanium II-IV, tungsten IV-VI, vanadium II-V and molybdenum II-IV. Particularly preferred metal ions are manganese, iron, cobalt and copper, most preferably manganese or iron) and ligand, preferably in pre-complexed form.

Preferred ligands, either bound to the transition metal ion, or unbound, comprise ligands with a plurality of binding sites, preferably at least four binding sites for transition metal ions. The binding sites are preferably selected from N, O, P and S or mixtures thereof, preferably being selected from N and O or mixtures thereof and most preferably comprising all N binding sites. Particularly preferred ligands are macropolycyclic cross-bridged ligands comprising (1) at least 4 donor atoms and (2) a moiety that comprises a cross-bridged chain that covalently connects at least 2 non-adjacent donor atoms of the organic macrocycle ring, the covalently connected donor atoms being donor atoms that are coordinate in the transition metal complex to the transition metal ion and the cross-bridged chain comprising from 2 to about 5 atoms. Preferably, the ligand is pre-complexed with the transition metal ion before incorporation into the particle and in this case, the transition metal atom is coordinated with said macropolycyclic cross-bridged ligand. These ligands and catalysts containing them are described in more detail in WO 98/39098.

Other ligands or transition metal catalysts containing them, which may be incorporated into the particles of the present invention are as described in WO 01/64826. As described in that reference, the particles of the present invention may contain ligands mixed with a metal salt $MX_n$ in which n=1–5, preferably 1–3 and X represents a coordinating species selected from any mono, bi, or tri charged anions and any neutral molecules able to coordinate the metal in a mono, bi or tridentate manner. Specific examples of such ligands include 1,4,7-tris(benzimidazol-2-ylmethyl)-1,4,7-triazacyclononane; 1,4,7-tris(N-methylbenzimidazol-2ylmethyl)-1,4,7-triazacyclononane; 1,4-bis(imidazol-2ylmethyl)-7-ethyl-1,4,7-triazacyclononane; 1,4,7-tris(4-bromo-pyrazol-3ylmethyl)-1,4,7-triazacyclononane; and 1,4,7-tris(pyrrole-2ylmethyl)-1,4,7-triazacyclononane.

Optionally the particle may contain ligand and metal salt, not in pre-complexed form. Optionally, however, a ligand for a bleach catalyst may be present within the particle and the transition metal ion may be provided from outside the particle. Such transition metal ion may contact the ligand from the particle under conditions of use, on dissolution of the particle. Where the transition metal ion and ligand are not in pre-complexed form, preferred ligands have a plurality of binding sites, preferably at least 3, most preferably at least 4, and the binding sites are preferably selected from N, O or mixtures thereof. The ligands specified in WO 01/64826 and WO 98/39098 are particularly preferred.

Preferably, the perfume, catalyst or ligand thereof is present in the particle in an amount of from 0.001 to 50 wt % based on the weight of the uncoated particle. The amount of bleach catalyst or ligand in the particle is generally at least 0.1 wt %, more typically at least 1 wt %, or even at least 2 wt %. Generally, the bleach catalyst will be present in the particle in an amount of no greater than 20 wt %, typically no greater than 15 wt %, or even no greater than 10 wt % based on the weight of the uncoated particle.

Preferably the weight ratio of protective agent to perfume, bleach catalyst, ligand thereof or mixtures thereof is at least 3:1, more preferably at least 5:1 and more preferably at least 7:1 or even higher. The weight ratio will generally not be above 99:1.

Preferably, the particle also contains a binder. Any known binder is suitable. These may be liquids such as soap/fatty acid mixtures, polyethylene glycol generally having molecular weight in the range from about 500 to about 3000, tallow-and coco-ethanolamides, nonionic surfactants such as ethoxylated nonionic surfactants or other nonionic ethoxylates such as $C_{12-22}$ alkyl ethoxylates having above 40 ethoxylate groups per molecule or even above 50 or above 60 ethoxylate groups per molecule such as tallow alcohol ethoxylate (50–80). Other suitable binders include polymers such as non-cellulosic homo-or co-polymeric materials generally having molecular weights from 500 to 100,000 such as polyvinylpyrrolidone (PVP), and polyacrylates (PAA) and maleic acid/maleate, acrylic acid/acrylate homo- or co-polymers; or cellulosic binders such as starches, gums, guar gums and other cellulosic binders well-known in the art; bentonite, montmorillonite clay and zeolite. These inorganic binders preferably have a small particle size, preferably the median particle size will be less than 10 $\mu$m.

Preferably any of the organic binders will have a melting point above 35° C., more preferably above 40° C. to 100° C.

When present, binders will generally be present in amounts from 1 to 50 wt % based on uncoated particle, preferably from 2 to 40 wt %, most preferably from 5 to 20 wt %. The particles of the invention may contain other optional ingredients such as stabilizers preferably selected from antioxidants and reducing agents. Such stabilisers are particularly preferred where the particles contain oxidisable binders such as the cellulosic binders described above. Suitable examples include butylated hydroxy toluene, butylated hydroxy anisole, nonyl phenol, vitamin E (d-alpha tocophenol), ascorbyl palmitate, di nonyl phenol, sodium hypophosphate, hypophosphorous acid, anthranilic acid, vitamin C (ascorbic acid), beta carotene, dilauryl thiopropionate, distearyl thiopropionate, ditridecyl thiopropionate, 2,5, ditertbutylhydroquinone, alkylated diphenylamine and aryl amine. Generally if present, these components will be present at low levels such as from 0.0001 to 5 wt %, preferably 0.001 to 2.5 wt % based on the weight of the uncoated particle. Acids may also be incorporated as stabilisers. Preferred acids are organic acids such as any mono-, di- or tri- carboxylic acid. Suitable examples include citric, tartaric malic, sebacic acids or other carboxylic acids. Other suitable acids are $C_{12-22}$ fatty acids. The pH of the particle, as measured with an electrode on a 10% aqueous solution of the particle after vigorous stirring for ten minutes, is preferably below 7, most preferably from 2 to 6.5, most preferably from 2 to 4.

The uncoated particles of the invention are preferably water-soluble and have a rate of solubility such that good dissolution in the wash is obtained. The measurement for rate of solubility is carried out by accurately weighing 10 g+/−0.05 g of a representative sample of particles. 1 litre deionised water is placed in a 1.5 liter beaker with diameter 100 mm and maintained at a temperature of 20° C. The water is agitated with a 200 rpm paddle stirrer having total width 750 mm. A pre-calibrated conductivity probe is inserted into the beaker. The accurately weighed sample is added and a timer is started. The increase in conductivity as the sample dissolves is monitored and plotted versus time. The end point of complete dissolution is noted and the conductivity plot is used to calculate the time at 95% dissolution: conductivity at 95% C(95%)=maximum conductivity X 0.95 and time at 95% dissolution is time when conductivity reading=C(95%). Preferably, the (uncoated) particles of the invention reach the 95% dissolution in no greater than 5 minutes, more preferably no greater than 3 minutes, most preferably no greater than 2 minutes 30 seconds.

The particles of the first embodiment of the invention (measured on uncoated particle) and preferably also of the other aspects of the invention have a moisture content no greater than 0.5 wt %, preferably no greater than 0.25 wt %, most preferably no greater than 0.2 wt %. Although it is preferred to have levels as low as possible, from 0%, there will generally be some moisture present as measured by the defined test, and levels are usually at least 0.0001 wt % or at least 0.001 wt %.

The particles of the first embodiment of the invention and preferably also of the other aspects of the invention have a moisture pick-up, measured on the uncoated particle, of no greater than 0.5 wt %, preferably no greater than 0.2 wt % and most preferably no greater than 0.15 wt %, or even no greater than 0.1 wt %. Levels as low as possible, such as even down to 0.0 wt % are preferred.

The particles according to the second aspect of the invention and preferably also according to the other aspects of the invention have a surface area (measured on the uncoated particle) no greater than 0.6 $m^2/g$ particles, most preferably no greater than 0.4 $m^2/g$, or even no greater than 0.25 $m^2/g$. If the surface area is too low, dissolution of the particle will be adversely affected, therefore preferably, the surface area will be at least 0.1 $m^2/g$ and preferably at least 0.2 $m^2/g$.

The median particle size of the particles according to the second aspect of the invention and preferably also according to the other aspects of the invention is from 200 to 1500 $\mu$m, more preferably from 200 to 1000 $\mu$m. Generally it is advantageous to have the particle size and bulk density of the particles approximating those of the detergent composition into which they are incorporated to ensure even dosage and avoid segregation. The bulk density and size of the particles of the present invention can be controlled by control of the ingredients in the particle and/or by the processing methods and conditions described below and as will be clear to a skilled practitioner.

Preferably less than 10 wt % of the particles, more preferably less than 5 wt % and most preferably less than 2.5 wt % of the particles will be below 200 $\mu$m. Preferably no more than 10 wt %, more preferably no more than 5 wt % and most preferably no more than 2.5 wt % of the particles will have a particle size greater than 1000 $\mu$m, more preferably no greater than 1000 $\mu$m.

Protective Agent

The particles of the invention generally comprises at least 30 wt %, more preferably at least 40 wt %, most preferably at least 50 wt % or even at least 60 or 70 wt % of the particle based on the weight of the uncoated particle. It is generally present in amounts no greater than 99.9 wt %, typically no greater than 95 or even 90 wt % based on the weight of the uncoated particle.

The particle size of the protective agent incorporated into the particles of the invention is such that the median is preferably from 20 to 150 $\mu$m. The median particle size may be at least 30 or at least 50 or even at least 75 $\mu$m. Generally the median particle size will be no greater than 125 $\mu$m or even no greater than 100 $\mu$m. Preferably the spread of particle size is such that 90 wt %, or even 95 wt % of the protective agent will be within a range of 50 $\mu$m.

The protective agent is preferably a water-soluble component. Preferably it is non-inert i.e. it comprises an ingredient which has an active effect in a detergent composition such that it contributes to affecting pH, building or bleaching activation properties of the detergent. Preferably, it is not a water sink i.e. does not physically bind water. According to the third aspect of the invention, the protective agent comprises bleach activator. Suitable activators include nitrile-quaternary ammonium activators for example as described in DE-A-196 49 384 and DE-A-196 49 375.

According to a fourth aspect of the invention, and preferably also in the other aspects of the invention, the protective agent comprises a reactant for water, the reactant reacting with water to form non-water reaction products. This has proved highly advantageous, because any water entering the particle is removed by such reaction. An additional advantage has been found when at least one of the reaction products comprises an acid as this further stabilises the active ingredients, particularly bleach catalysts in the particle. Examples of suitable materials include acid anhydrides which react with water to form two moles of organic acid, esters and amides. Peroxy acid bleach precursors (i.e. bleach activators) are particularly preferred.

Bleach Activators

Peroxyacid Bleach Precursor

Peroxyacid bleach precursors suitable for us as the protective agent include compounds that react with hydrogen peroxide in a perhydrolysis reaction to produce a peroxyacid. Generally peroxyacid bleach precursors may be represented as:

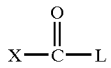

where L is a leaving group and X is essentially any functionality, such that on perhydrolysis the structure of the peroxyacid produced is:

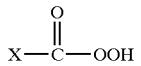

Suitable peroxyacid bleach precursor compounds typically contain one or more N-or O-acyl groups, such precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter "L group", must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

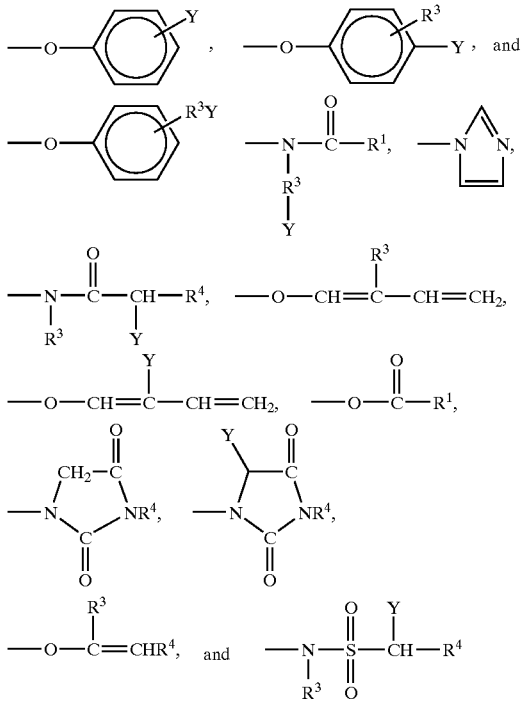

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<--N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis. Preferred alkyl percarboxylic precursor compounds of the imide type include the N—, $N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. Other preferred alkyl percarboxylic acid precursors include sodium 3,5,5,-tri-methyl hexanoyloxybenzene sulfonate (iso-NOBS), sodium nonanoyloxybenzene sulfonate (NOBS), sodium acetoxybenzene sulfonate (ABS) and pentaacetyl glucose. When the bleach precursor hydrophilic, more particularly when it comprises TAED, preferably it is present in amounts of at least 1.5%, or even at least 3.5% by weight, most preferably at least 5% by weight or greater of the total detergent composition.

Amide Substituted Alkyl Peroxyacid Precursors

Preferred peroxyacid precursors are amide substituted alkyl peroxyacid precursor compounds, including those of the following general formulae:

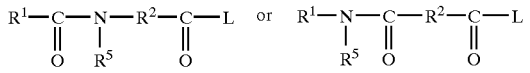

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Preferred examples of bleach precursors of this type include amide substituted peroxyacid precursor compounds selected from (6-octanamido-caproyl)oxybenzenesulfonate, (6-decanamido-caproyl) oxybenzene-sulfonate, and the highly preferred (6-nonanamidocaproyl)oxy benzene sulfonate, and mixtures thereof as described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Precursors

Cationic peroxyacid precursor compounds produce cationic peroxyacids on perhydrolysis. Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion. The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter. Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512; 458,396 and 284,292; and in JP 87-318,332. Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

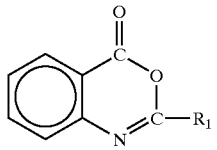

wherein $R_1$ is an alkyl, alkaryl, aryl, or arylalkyl.

N-Acylated Lactam Precursors

Still another class of hydrophobic bleach activators are the N-acylated precursor compounds of the lactam class disclosed generally in GB-A-955735. Preferred materials of this class comprise the caprolactams. Suitable caprolactam bleach precursors are of the formula:

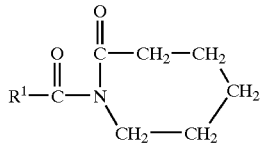

wherein $R^1$ is an alkyl, aryl, alkoxyaryl or alkaryl group containing from 6 to 12 carbon atoms. Preferred hydrophobic N-acyl caprolactam bleach precursor materials are selected from benzoyl caprolactam, octanoyl caprolactam, nonanoyl caprolactam, decanoyl caprolactam, undecenoyl caprolactam, 3,5,5-trimethylhexanoyl caprolactam and mixtures thereof. A most preferred is nonanoyl caprolactam. Suitable valero lactams have the formula:

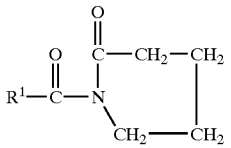

wherein $R^1$ is an alkyl, aryl, alkoxyaryl or alkaryl group containing from 6 to 12 carbon atoms. More preferably, $R^1$ is selected from phenyl, heptyl, octyl, nonyl, 2,4,4-trimethylpentyl, decenyl and mixtures thereof. Mixtures of any of the peroxyacid bleach precursor, herein before described, may also be used.

It has surprisingly been found that combination of bleach catalysts and bleach activator in close proximity, not only assists in stability of the particle, but may also provide improved cleaning.

The particles of the invention can be prepared by any of the conventional and known granulation requirements, such as pan-granulator, fluidized bed, Schugi mixer, Lödige ploughshare mixer, rotating drum and other low energy mixers; by compaction, including extrusion and tabletting optionally followed by pulverising and/or grinding; when melt binding agents are used by prilling and pastilling using a Sandvik Roto Former; and by high shear processes in which the mixers have a high speed stirring and cutting action. Suitable mixers will be well known to those skilled in the art.

However, particularly preferred processing techniques are extrusion and roller compaction. In an extrusion process for example, a pre-mix of the total components of the uncoated particle is prepared, in a low shear mixer such as a Lödige batch low shear mixer. The resulting homogeneous mixture is then passed under high pressure (such as a twin screw extruder) through an aperture or series of apertures of the required size. Preferred apertures for generating the preferred particle-size particles of the invention are of the order of 600–800 $\mu$m diameter apertures. A radial-type extruder may be used and the level of any binder or other liquid component may need to be adjusted to control the extrusion pressure to a practicable level; the addition of increased levels of liquid components generally reduces extrusion pressure. After cooling the resulting extruded strands are then broken up via high shear mixing and classified to the desired particle size.

In a suitable roller compaction process a pre-mix of ingredients with the desired final particle composition is prepared for example, in a low shear mixer. The resulting homogeneous mixture is then fed for example, by gravity through a transfer hopper to two compaction rolls with a nip gap of from 0.25 mm to 20 mm, generally around 0.5 to 10 mm and most preferably around 1 mm. The ingredients are compacted via the rolls to form a continuous compacted sheet. The compacted sheet is then broken up via high shear mixing and classified to achieve compacted particles of the desired particle size.

During processing, In order to achieve low moisture content of the finished particles, the raw materials are preferably mixed in dried form and in addition, the humidity of the air surrounding at least some, preferably all of the processing steps is carefully controlled to prevent moisture being incorporated into the particles and promoting reaction between the different ingredients in the particle during processing. Preferably the ambient humidity will be controlled to below 40% RH or even below 25% RH or lower.

The particles of the invention may optionally be coated to further enhance storage stability and/or to improve aesthetics. Such a coating may be provided by any water-soluble layer known in the art such as the polymeric materials described above as optional binding agents or water-soluble salts such as sulphates, silicates, carbonates bicarbonates or mixtures thereof. Certain coatings include one or mixtures of more than one hydrophobic coating material selected from saturated or unsaturated, preferably saturated, paraffin wax, fatty acid, glycerol, fatty soaps, fatty esters, mono-, di- or tri- glycerides. Of these, preferred are one or mixtures of more than one hydrophobic coating material selected from saturated or unsaturated, preferably saturated, paraffin wax, fatty acid, fatty soaps, fatty esters, mono-, di- or tri- glycerides. Preferred coating agents are not hygroscopic. Preferred coatings are provided by surface powder coating provided by a very fine particulate material, often a flow aid with mean particle size less than 25 $\mu$m, or even less than 20 $\mu$m or 15 $\mu$m. The coating is preferably no more than 20 wt %, preferably no more than 10 wt % of the total weight of the coated particle, but when present will usually be at least 1%, or even at least 2% by weight of the coated particle. The powdered coating will be water-soluble or dispersible and may be inorganic or organic and crystalline or amorphous. It will generally improve flow rates of the particles of the invention. Suitable materials include silica, talc, clay minerals such as smectite, montmorillonite or other clays and aluminosilicates such as zeolite.

The present invention also includes detergent compositions comprising the particles out-lined above and methods of washing in which the particles defined above are contacted with water to provide a wash liquor for washing, particularly fabrics.

The detergent compositions of this invention will contain at least 0.01 wt % of the claimed particles, preferably at least 0.05 wt % or even at least 0.1 wt % based on the total weight of the detergent composition. Generally, unless used in a pre-treatment step when higher concentrations such as up to 10 or even 20 wt % of the particles of the invention may be used, they will be used in detergent compositions in amounts no greater than 5 wt %, generally in amounts below 2.5 wt % and most likely below 1 wt %.

Adjunct Components

The detergent compositions of the present invention comprise, in addition to the particles already described above, detergent adjunct components. Generally the detergent compositions of the invention comprise from 80 wt % to 99.99 wt %, preferably from 90 wt %, or from 95 wt % to 97.5 or 99 wt % adjunct components. Preferred adjunct components are selected from the group consisting of: anti-redeposition agents, bleaching agents, brighteners, builders, chelants, dye-transfer inhibitors, enzymes, fabric-integrity agents, fillers, flocculants, perfumes, soil release agents, surfactants, soil-suspension agents, dispersants, alkalinity source, suds supressors, softening systems and combinations thereof.

A highly preferred adjunct component is a surfactant. Preferably, the detergent composition comprises one or more surfactants. Typically, the detergent composition comprises (by weight of the composition) from 0% to 50%, preferably from 5% and preferably to 40%, or to 30%, or to 20% one or more surfactants. Preferred surfactants are anionic surfactants, non-ionic surfactants, cationic surfactants, zwitterionic surfactants, amphoteric surfactants, catanionic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. The $C_{8-18}$ alkyl sulphates and/or $C_{8-18}$ alkyl sulphonates may optionally be condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups. Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_{8-18}$ alkyl benzene sulphonate, and combinations thereof. Preferred alkali metals are sodium, potassium and mixtures thereof. Typically, the detergent composition comprises from 5% to 30 wt % anionic surfactant.

Preferred non-ionic surfactants are selected from the group consisting of: $C_{8-18}$ alcohols condensed with from 1 to 9 of $C_1$–$C_4$ alkylene oxide per mole of $C_{8-18}$ alcohol, $C_{8-18}$ alkyl N—$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof. Typically the detergent compositions of the invention comprises from 0 to 15, preferably from 2 to 10 wt % non-ionic surfactant.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the detergent composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides. Catanionic surfactants which are complexes comprising a cationic surfactant and an anionic surfactant may also be included. Typically, the molar ratio of the cationic surfactant to anionic surfactant in the complex is greater than 1:1, so that the complex has a net positive charge.

A preferred adjunct component is a builder. Preferably, the detergent composition comprises (by weight of the composition and on an anhydrous basis) from 5% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; silicates such as layered silicates, salts thereof, and combinations thereof, preferably sodium layered silicate; and combinations thereof.

A preferred adjunct component is a bleaching agent. Preferably, the detergent composition comprises one or more bleaching agents. Typically, the composition comprises (by weight of the composition) from 1% to 50% of one or more bleaching agent. Preferred bleaching agents are selected from the group consisting of sources of peroxide, sources of peracid, bleach boosters, bleach catalysts, photo-bleaches, and combinations thereof. Preferred sources of peroxide are selected from the group consisting of: perborate monohydrate, perborate tetrahydrate, percarbonate, salts thereof, and combinations thereof. Preferred sources of peracid are selected from the group consisting of: bleach activators, preformed peracids, and combinations thereof. Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED) and peroxide source such as percarbonate. Preferred oxy-benzene-sulphonate bleach activators are selected from the group consisting of: nonanoyl-oxy-benzene-sulponate, 6-nonamido-caproyl-oxybenzene-sulphonate, salts thereof, and combinations thereof. Preferred lactam bleach activators are acyl-caprolactams and/or acyl-valerolactams. A preferred imide bleach activator is N-nonanoyl-N-methyl-acetamide. Preferred preformed peracids are selected from the group consisting of N,N-pthaloyl-amino-peroxycaproic acid, nonyl-amido-peroxyadipic acid, salts thereof, and combinations thereof. Preferably, the STW-composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in the following U.S. Pat. Nos. 5,360,568; 5,360,569 and 5,370,826.

A preferred adjunct component is an anti-redeposition agent. Preferably, the detergent composition comprises one or more anti-redeposition agents. Preferred anti-redeposition agents are cellulosic polymeric components, most preferably carboxymethyl celluloses.

A preferred adjunct component is a chelant. Preferably, the detergent composition comprises one or more chelants. Preferably, the detergent composition comprises (by weight of the composition) from 0.01% to 10% chelant. Preferred chelants are selected from the group consisting of: hydroxyethane-dimethylene-phosphonic acid, ethylene diamine tetra(methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the detergent composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

A preferred adjunct component is an enzyme. Preferably, the detergent composition comprises one or more enzymes. Preferred enzymes are selected from then group consisting of: amylases, arabinosidases, carbohydrases, cellulases, chondroitinases, cutinases, dextranases, esterases, β-glucanases, gluco-amylases, hyaluronidases, keratanases, laccases, ligninases, lipases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred enzymes are selected from the group consisting of: amylases, carbohydrases, cellulases, lipases, proteases, and combinations thereof.

A preferred adjunct component is a fabric integrity agent. Preferably, the detergent composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO 99/14245. Other preferred fabric integrity agents are polymeric components and/or oligomeric components that are obtainable, preferably obtained, by a process comprising the step of condensing imidazole and epichlorhydrin.

A highly preferred adjunct component is a flocculant. Preferably, the detergent composition comprises (by weight of the composition) from 0.01% to 25%, preferably from 0.5%, and preferably to 20%, or to 15%, or to 10%, or to 5% one or more flocculants. Preferred flocculants are polymeric components, typically having a weight average molecular weight of at least 100 kDa, preferably at least 200 kDa. Preferred flocculants are polymeric components derived from monomeric units selected from the group consisting of: ethylene oxide, acrylamide, acrylic acid, dimethylamino ethyl methacrylate, vinyl alcohol, vinyl pyrrolidone, ethylene imine, and combinations thereof. Other preferred flocculants are gums, especially guar gums. A highly preferred flocculant is polyethylene oxide, preferably having a weight average molecular weight of at least 100 kDa, preferably at least 200 kDa. Preferred flocculants are described in WO 95/27036.

A preferred adjunct component is a salt. Preferably, the detergent composition comprises one or more salts. The salts can act as alkalinity agents, buffers, builders, co-builders, encrustation inhibitors, fillers, pH regulators, stability agents, and combinations thereof. Typically, the detergent composition comprises (by weight of the composition) from 5% to 60% salt. Preferred salts are alkali metal salts of aluminate, carbonate, chloride, bicarbonate, nitrate, phosphate, silicate, sulphate, and combinations thereof.

Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the detergent composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethylterephthalate, 1,2-propyl glycol and methyl capped polyethyleneglycol. Other preferred soil release agents are anionically end capped polyesters.

A preferred adjunct component is a soil suspension agent. Preferably, the detergent composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula:

$$\text{bis}((C_2H_5O)(C_2H_4O)_n(CH_3)\text{—}N^+\text{—}C_xH_{2x}\text{—}N^+\text{—}(CH_3)\text{-}\text{bis}((C_2H_4O)_n(C_2H_5O)),$$

wherein, n=from 10 to 50 and x=from 1 to 20. Optionally, the soil suspension agents represented by the above formula can be sulphated and/or sulphonated.

Softening System

The detergent compositions of the invention may comprise softening agents for softening through the wash such as clay optionally also with flocculant and enzymes.

Detergent Composition

The detergent composition is typically a fully formulated laundry detergent composition or may be an additive for use in the washing stage of a laundering process. Preferably, however, the detergent composition is a fully formulated detergent composition.

The detergent composition will generally be in the form of a solid composition. Solid compositions include powders, granules, noodles, flakes, bars, tablets, and combinations thereof. The detergent composition may be in the form of a liquid composition. The detergent composition may also be in the form of a paste, gel, suspension, or any combination thereof. The detergent composition may be at least partially enclosed, preferably completely enclosed, by a film or laminate such as a water-soluble and/or water-dispersible material. Preferred water-soluble and/or water-dispersible materials are polyvinyl alcohols and/or carboxymethyl celluloses. Preferably, the detergent composition is in the form of a solid composition, most preferably a particulate solid composition. Typically, the detergent composition has a bulk density of from 300 g/l to 1500 g/l, preferably from 600 g/l to 900 g/l. Preferably, the detergent composition has a size average particle size of from 200 $\mu$m to 2000 $\mu$m, preferably from 350 $\mu$m to 600 $\mu$m.

Typically, the detergent composition is obtainable, preferably obtained, by a process comprising a step selected from the group consisting of spray-drying, agglomeration, extrusion, spheronisation, and combinations thereof. Typically, the detergent composition comprises spray-dried particles, agglomerates, extrudates, and combinations thereof. The detergent composition may comprise particles that have been spheronised, for example marumerised particles.

EXAMPLES

Example 1

A 5 kg batch of particles of the invention is prepared by an extrusion process from a pre-mix of components as set out in Table 1.

TABLE 1

| | Wt % |
|---|---|
| Bleach catalyst | 5 |
| TAED bleach activator | 81 |
| Mykon (tradename Warwick International) powder with d50 from 50–100 $\mu$m | |
| TAE 50 (Genapol T500-tradename of Clariant) | 14 |

The bleach catalyst was Mn(II) complexed with a rigid, bridged-cyclam ligand

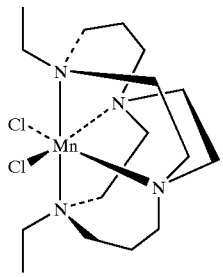

The ingredients in the proportions listed in table 1 are mixed in a Lödige-type batch low shear mixer at 40 to 50°. The resulting homogeneous mixture is passed in a twin screw extruder at high pressure through a series of apertures 600–800 $\mu$m diameter. A radial type extruder is used. After cooling, the resulting extrudate strands are then broken up in a high shear mixer and classified to obtain particles having a median particle size 800 $\mu$m with a range of 250 to 1200 $\mu$m.

The particles obtained have a surface area 0.39 $m^2/g$, moisture content of 0.15% and moisture pick-up 0.07%.

Example 2

A premix of the ingredients listed in table 1 is mixed in a low shear mixer. The resulting homogeneous mixture is then fed via gravity through a transfer hopper to two compaction rolls with a nip gap of 1 mm. The mixture is then compacted via the rolls to form a continuous compacted sheet. The compacted sheet is then broken up via high shear milling and classified to achieve compacted particles of median particle size of 600 microns with a range of 250 to 1200 microns. The humidity of the ambient air surrounding this process is carefully controlled to <25% throughout the process.

COMPOSITION EXAMPLES

The following detergent compositions incorporating the particles of Examples 1 and 2 are examples of compositions according to the invention.

Compositions A–G have a bulk density of from 640 g/l to 850 g/l.

| Ingredient | A | B | C | D | E | F | G |
|---|---|---|---|---|---|---|---|
| Particle of Example 1 | 0.2 | 0.2 | 0.3 | 0.3 | 0.1 | 0.15 | 0.2 |
| Alkoxylated alcohol | 0.02 | 0.5 | | | | 0.1 | 1 |
| C28AS | 0.5 | 10 | 10 | | | | 2 |
| C28E5 | 3 | 4 | | | | | |
| C28E7 | | | | | | | 2 |
| C28E9 | | | 0.4 | | | | |
| C25E3S | 1 | 3 | | | 0.8 | | 0.5 |
| C45E3S | | | 2 | | | | |
| C45E7 | | | | | | 4 | |
| FAS | 2 | 0.05 | | | | | 0.05 |
| LAS | 5 | 5 | 4 | 15 | 20 | 7 | 8 |
| QAS(1) | | | | | 0.6 | 0.5 | |
| QAS(2) | | 0.8 | | | | | 0.5 |
| QAS(3) | | | | 2 | | | |
| Acetate | | | | | | | 6 |
| Carbonate | 25.8 | 5.8 | 30.7 | 15.7 | 12.9 | 16.85 | 11.8 |
| Citrate | | 1.5 | | | | | 3 |
| Silicate | 0.05 | 0.5 | 0.6 | 25 | 8 | 4 | 0.4 |
| Sulfate | 22 | 3 | 3 | 0.4 | 3 | 14 | 0.5 |
| STPP | | | | | 36 | 18 | |
| Citric Acid | 2.5 | 1 | | | | 2 | 4 |
| NaSKS-6 | 2 | 12 | | 6 | | | 13 |
| Zeolite A | 15 | 18 | 32 | 11 | | 1 | 9 |
| Adipic acid | | | | | | | 6 |
| CHDM | | | | | | | 0.3 |
| DIBS | | | | | | | 0.2 |
| DTPA | | | 0.7 | | 0.4 | 0.5 | |
| EDDS | 0.1 | 0.5 | | | | | 0.4 |
| HEDP | 0.1 | 0.4 | | | | | 0.5 |
| Mg Sulfate | 0.5 | 0.08 | | | 0.4 | 1.5 | 0.1 |
| PB1 | | | 1.5 | | 3 | 8 | |
| PB4 | | | | | | 5 | |
| Percarbonate | 12 | 20 | | 2.8 | | | 12 |
| NAC_OBS | | | | | | | |
| NOBS | | | 2.5 | 3 | 0.8 | | |
| TAED | 2.5 | 6 | | | 0.5 | 1.5 | 4 |
| Photobleach (1) | 0.001 | | | | 0.001 | 0.01 | 0.002 |
| Photobleach (2) | | | | | | 0.001 | |
| Brightener (1) | 0.02 | 0.1 | 0.05 | 0.2 | 0.3 | 0.1 | 0.01 |
| Brightener (2) | 0.02 | | | | | 0.15 | 0.005 |
| PVI | | | 0.35 | | | | |
| PVP | | | 0.2 | | | | |
| PVNO | | | 0.3 | | | | |
| PVPVI | | | 0.4 | | | | |
| Dye fixative | | | 0.08 | | 0.05 | | 0.01 |
| EMC | | | 3 | | 0.6 | 1 | 1 |
| PEG | | | | | | | 2.2 |
| $PEG_{4000}$ | | | 1.6 | 0.2 | | | |
| $PEG_{8000}$ | | | 0.2 | | | | |
| MMC | | | | 0.2 | | | |
| PEI(2) | | | | | 0.15 | | |
| CMC | 0.15 | 0.4 | | | 0.45 | 0.1 | |
| AA | | | 1 | | 0.8 | | |
| MA/AA(1) | 1.5 | 1.2 | | | | 1.5 | 1 |
| MA/AA(2) | | | | 8 | | | |
| QEA(1) | 0.5 | 1 | | | | 4 | 1.5 |
| QEA(2) | | | | | 1 | | |
| SRP(1) | 0.1 | 0.25 | | 0.1 | | 0.05 | |
| SRP(2) | | | | | | | |
| Amylase | 0.5 | 0.5 | | | 0.15 | 0.1 | 0.5 |
| Cellulase | 0.1 | 0.15 | 0.4 | | 0.1 | 0.1 | 0.1 |
| Lipase | 0.15 | 0.2 | | | | 0.05 | |
| Protease | 0.1 | 0.5 | 0.15 | 0.2 | 0.5 | 0.3 | 0.7 |
| Silicone antifoam | 0.05 | 0.3 | 0.01 | 0.7 | 0.05 | 0.05 | 0.3 |
| Soap | 0.6 | | | | | | 0.5 |
| Perfume | 0.3 | 0.65 | 0.4 | 0.2 | 0.2 | 0.35 | 0.8 |
| Encap | | 0.2 | | | 0.2 | 0.3 | |

-continued

| Ingredient | A | B | C | D | E | F | G |
|---|---|---|---|---|---|---|---|
| perfume | | | | | | | |
| Mis-cellaneous | to 100% | | | | | | |

| Abbreviation | Description |
|---|---|
| Alkoxylated alcohol: | Tallow alcohol ethylene oxide condensate of type tallow alcohol, condensed with an average of from 50 to 100 moles of ethylene oxide |
| CxyAS: | Sodium $C_{1x}$–$C_{1y}$ alkyl sulphate |
| CxyEz: | $C_{1x}$–$C_{1y}$ predominantly linear primary alcohol condensed with an average of z moles of ethylene oxide |
| CxyEzS: | Sodium $C_{1x}$–$C_{1y}$ alkyl sulfate condensed with z moles of ethylene oxide |
| FAS: | Fatty alkyl sulfate |
| LAS: | Sodium linear $C_{11}$–$C_{13}$ alkyl benzene sulfonate |
| QAS(1): | $R_2.N^+(CH_3)_2(C_2H_4OH)$, wherein $R_2 = C_{12}$–$C_{14}$ |
| QAS(2): | $R_2.N^+(CH_3)_2(C_2H_4OH)$, wherein $R_2 = C_8$–$C_{11}$ |
| QAS(3): | $R2.N^+(CH_3)(C_2H_4OH)_2$, wherein $R_2 = C_7$–$C_{12}$ |
| Acetate: | Sodium acetate |
| Carbonate: | Anhydrous sodium carbonate |
| Citrate: | Tri-sodium citrate dihydrate |
| Silicate: | Amorphous sodium silicate ($SiO_2$:$Na_2O$ = from 2:1 to 4:1) |
| Sulfate: | Anhydrous sodium sulfate |
| Adipic acid: | Adipic acid |
| CHDM: | Cyclo hexane di-methanol |
| DIBS: | Di-isopropyl benzene sulphonate |
| DTPA: | Diethylene triamine pentaacetic acid |
| EDDS: | Ethylenediamine-N'N'-disuccinic acid, (S,S) isomer in the form of a sodium salt |
| HEDP: | 1,1-hydroxyethane diphosphonic acid |
| Mg sulfate: | Anhydrous magnesium sulfate |
| PB1: | Anhydrous sodium perborate bleach of nominal formula $NaBO_3.H_2O$ |
| PB4: | Sodium perborate tetrahydrate of nominal formula $NaBO_3.4H_2O$ |
| Percarbonate: | Sodium percarbonate of the nominal formula $2Na_2CO_3.3H_2O_2$ |
| NAC-OBS: | (6-nonamidocaproyl) oxybenzene sulfonate |
| NOBS: | Nonanoyloxybenzene sulfonate |
| TAED: | Tetraacetylethylenediamine |
| Photobleach(1): | Sulfonated zinc phthalocyanine |
| Photobleach(2): | Sulfonated alumino phthalocyanine |
| Brightener(1): | Disodium 4,4'-bis-(2-sulfostyryl)biphenyl, supplied by Ciba-Geigy under the tradename Tinopal CBS |
| Brightener(2): | Disodium 4,4'-bis-((4-anilino-6-morpholino-s-triazin-2-yl)-amino}-2,2'-stilbenedisulfonate |
| PVI: | Polyvinyl imidosole having a weight average molecular weight of 20000 |
| PVP: | Polyvinyl pyrolidone polymer having a weight average molecular weight of 60000 |
| PVNO: | Polyvinyl pyridine N-oxide polymer having a weight average molecular weight of 50000 |
| PVPVI: | Copolymer of polyvinyl pyrolidone and vinyl imidazol, having a molecular weight of 20000 |
| Dye fixative: | Oligomer produced by the condensation of imidazole and epichlorhydrin |
| EMC: | Ester modified cellulose |
| PEG: | Polyethylene glycol having a weight average molecular weight of x, wherein X = from 1000 to 12000 |
| CMC: | Sodium carboxymethyl cellulose |
| AA: | Sodium polyacrylate polymer having a weight average molecular weight of from 3000 to 5000 |
| MA/AA(1): | Copolymer of maleic/acrylic acid, having a weight average molecular weight of from 50000 to 90000, wherein the ratio of maleic to acrylic acid is from 1:3 to 1:4 |
| PEI(2): | Propoxylated polyethyleneimine having a weight |

-continued

| Abbreviation | Description |
|---|---|
| | average molecular weight of from 1000 to 4000 and an average ethoxylation degree of from 5 to 30 ethoxy residues per nitrogen |
| QEA(1): | bis($(C_2H_50)(C_2H_4O)n$)($CH_3$)—N+—$C_xH_{2x}$—N+—($CH_3$)-bis($(C_2H_5O)(C_2H_40)n$), wherein n = from 20 to 30, and x = from 3 to 8 |
| QEA(2): | sulphonated or sulphated bis($(C_2H_50)(C_2H_4O)n$)($CH_3$)—N+—$C_xH_{2x}$—N+—($CH_3$)-bis($(C_2H_5O)(C_2H_40)n$), wherein n = from 20 to 30, and x = from 3 to 8 |
| SRP(1): | Anionically end capped polyesters |
| SRP(2): | Copolymer of dimethylterephthalate/propylene glycol/methyl capped polyethyl glycol |
| Amylase: | Amylolytic enzyme having from 25 mg to 50 mg active enzyme/g, selected from the group consisting of enzymes supplied by Novo industries A/A under the tradenames Natalase, Duramyl, Termamyl, BAN or mixtures thereof |
| Cellulase: | Cellulytic enzyme having from 10 mg to 40 mg active enzyme/g, selected from the group consisting of enzymes supplied by Novo Industries A/S under the tradenames Carezyme, EndoA, or mixtures thereof |
| Lipase: | Lipolytic enzyme having from 10 mg to 40 mg active enzyme/g, selected from the group consisting of enzymes supplied by NOVO Industries A/S under the tradename Lipolase, Lipolase Ultra, or mixtures thereof |
| Protease: | Proteolytic enzyme having from 15 mg to 70 mg active enzyme/g, selected from the group consisting of enzymes supplied by Genencor under the tradename FN2, FN3, FN4, enzymes supplied by NOVO Industries A/S under the tradename Savinase, Alcalase, or mixtures thereof |
| Silicone antifoam: | Polydimethyl siloxane foam controller with siloxane-oxyalkylene copolymer as dispersing agent, wherein the ratio of said foam controller to said dispersing agent is from 10:1 to 100:1 |
| Soap: | Sodium linear alkyl carboxylate that is derived from a mixture of tallow and coconut fatty acids, wherein the ratio of tallow to coco fatty acids is from 70:30 to 99:1 |
| Perfume: | Perfume |
| Encap Perfume: | Encapsulated perfume |

What is claimed is:

1. A particle comprising a.) a bleach catalyst or ligand thereof;

b.) a protective agent; and c.) a coating, said coating comprising an inorganic component, selected from the group consisting of silica, sodium carbonate, zeolite, titanium di-oxide, or mixtures thereof;

said particle, when measured without said optional coating, having a moisture content of less than 0.5 wt %, and a moisture pick-up of no greater than 0.5 wt %.

2. A particle comprising:

a.) a bleach catalyst or ligand thereof;

b.) a protective agent; and c.) a coating, said coating comprising an inorganic component, selected from the group consisting of silica, sodium carbonate, zeolite, titanium di-oxide or mixtures thereof;

said particle, when measured without said optional coating, having a surface area of no greater than 0.6 $m^2/g$, and a median particle size from 200 to 1000 $\mu m$.

3. A particle according to claim 1, comprising a stabilising agent.

4. A particle according to claim 1, wherein the protective agent comprises reactant for water.

5. A particle according to claim 4, wherein said protective agent comprises a protective agent that reacts with water to form a bleach catalyst stabilising agent.

6. A particle according to claim 5, wherein the stabilising agent is an organic acid comprising at least 6 carbon atoms.

7. A particle according to claim 5, wherein said stabilising agent is an acid having a pKa below 2.

8. A particle according to claim 1, wherein said protective agent comprises a bleach activator.

9. A particle according to claim 8, wherein said bleach catalyst or component thereof is present in the particle in an amount of from 0.001 wt % to 35 wt % by weight of said particle.

10. A particle according to claim 1, wherein the protective agent is present in the particle in an amount of from 50 to 99.99 wt % by weight of said particle.

11. A particle according to claim 1, wherein said coating comprises one or mixtures of more than one hydrophobic coating material selected from saturated or unsaturated materials.

12. A particle according to claim 1, wherein said inorganic component comprises a micronised, inorganic component having a weight average particle size of less than 25 microns.

13. A detergent composition comprising a particle according to claim 1.

14. A detergent composition according to claim 13, comprising from 0.005 to 5 wt % of said particles.

15. A method for cleaning fabrics comprising contacting the fabrics with an aqueous solution comprising a particles according to claim 1.

16. A particle according to claim 1, having a moisture content of less than 0.25 wt % and a moisture pick-up of no greater than 0.2 wt %.

17. A particle according to claim 2, said particle, when measured without said coating, having a surface area of no greater than 0.4 $m^2/g$.

18. A particle according to claim 1, comprising a stabilising agent that is an acid.

19. A particle according to claim 11, wherein said coating comprises a material selected from the group consisting of saturated, paraffin wax, fatty acid, fatty soaps, fatty esters, mono-, di- or tri- glycerides and mixtures thereof.

* * * * *